US005879150A

United States Patent [19]

Crichton

[11] Patent Number: 5,879,150

[45] Date of Patent: Mar. 9, 1999

[54] FLAMELESS IGNITER FOR USE WITH A TANK BURNER OF A FLUID FUEL SYSTEM

[76] Inventor: Henry Crichton, P.O. Box 474, Maidstone, Saskatchewan, Canada

[21] Appl. No.: 74,731

[22] Filed: May 8, 1998

[51] Int. Cl.[6] ..... F23Q 7/08

[52] U.S. Cl. ..... 431/260; 126/25 B

[58] Field of Search ..... 431/260; 126/25 B

[56] References Cited

U.S. PATENT DOCUMENTS

| | | | |
|---|---|---|---|
| 722,913 | 3/1903 | Shmitt et al. . | |
| 1,496,028 | 6/1924 | Scott | 431/260 |
| 1,845,305 | 2/1932 | Macrae . | |
| 2,274,573 | 2/1942 | Ziegler . | |
| 2,440,491 | 4/1948 | Schwander . | |
| 2,493,743 | 1/1950 | Benson . | |
| 2,540,277 | 2/1951 | Molotzak . | |
| 2,721,607 | 10/1955 | Damon et al. . | |
| 2,776,394 | 1/1957 | Cuny et al. . | |
| 2,880,792 | 4/1959 | Raskin . | |
| 2,921,239 | 1/1960 | Dryden . | |
| 2,941,363 | 6/1960 | Cuny et al. . | |
| 3,138,193 | 6/1964 | Hageman . | |
| 3,397,536 | 8/1968 | Davies et al. . | |
| 3,562,590 | 2/1971 | Mitts et al. . | |
| 4,019,851 | 4/1977 | Smith et al. . | |
| 4,190,034 | 2/1980 | Wonisch . | |
| 4,253,820 | 3/1981 | Jarreau . | |
| 4,941,817 | 7/1990 | Schlosser . | |
| 5,616,022 | 4/1997 | Moran IV . | |

*Primary Examiner*—Carroll B. Dority
*Attorney, Agent, or Firm*—Terry M. Gernstein

[57] ABSTRACT

A flameless igniter has a special shape and includes a flow control port to make efficient use of fuel during a flame ignition process associated with a tank burner of a fluid fuel system. The igniter uses a spark to ignite fuel and includes a handle and a spark gap whereby the igniter is effective even in difficult-to-reach locations on a tank burner.

2 Claims, 2 Drawing Sheets

FLAMELESS IGNITER FOR USE WITH A TANK BURNER OF A FLUID FUEL SYSTEM

TECHNICAL FIELD OF THE INVENTION

The present invention relates to the general art of igniters, and to the particular field of igniters used to ignite and re-ignite gas burners.

BACKGROUND OF THE INVENTION

Fluid fuel burner systems are well known in the art. These systems are used for a wide variety of applications including heating systems and the like.

While convenient, these systems have some drawbacks. Since most fluid fuel burner elements of such systems require a flame of some sort, they must be ignited. In some instances, these flames can become extinguished and must be re-ignited.

Igniting a flame of a burner element of a fluid fuel burner system usually requires an initial flow of fuel followed by activation of the element used to ignite that fuel. This initial flow of fuel can be wasteful of fuel if the flame is not immediately ignited. If the fuel flow rate is during ignition is too low, the fuel may not ignite and simply flow into the environment surrounding the burner. If the fuel flow rate is too high during ignition, the fuel may extinguish the igniter element. In both instances, the igniting process can be inefficient and waste fuel.

Therefore, there is a need for an igniter element that can efficiently light a burner element of a fluid fuel burner system.

Still further, many burner flames are positioned in difficult-to-reach locations. This makes initial ignition and re-ignition onerous. This may require a person to establish a body position or location that is quite uncomfortable. This may result in hurried attempts to ignite a flame with inefficient results.

Therefore, there is a need for an igniter for use with a burner of a fluid fuel burner system which can expedite ignition and re-ignition of a fluid fuel burner system.

While the art contains several igniter systems, these systems are often complex, expensive and difficult to use while still not making efficient use of fuel.

OBJECTS OF THE INVENTION

It is a main object of the present invention to provide an igniter for use with a fluid fuel burner system.

It is another object of the present invention to provide an igniter for use with a fluid fuel burner system that makes efficient use of the fuel during ignition and re-ignition of the system.

It is another object of the present invention to provide an igniter for use with a fluid fuel burner system that can easily reach a location for most efficiently igniting the flame of the system.

SUMMARY OF THE INVENTION

These, and other, objects are achieved by a flameless igniter for use with a tank burner of a fluid fuel system that captures and holds just the right amount of fuel to efficiently ignite a flame of a fuel burner and is designed to reach even difficult-to-reach flames whereby efficient use of fuel is made during ignition and re-ignition of the system.

BRIEF DESCRIPTION OF THE DRAWING FIGURES

DETAILED DESCRIPTION OF THE PREFERRED EMBODIMENT OF THE INVENTION

As shown in the figures, the invention disclosed herein broadly is directed to a flameless igniter 10 for use with a tank burner of a fluid fuel system. Igniter 10 makes efficient use of fuel by capturing and holding the right amount of fuel in close proximity with the igniting elements thereof. Igniter 10 further is designed to easily reach even difficult to reach locations whereby fuel will not be wasted because of limited access to the flame of the system.

Figure 2:
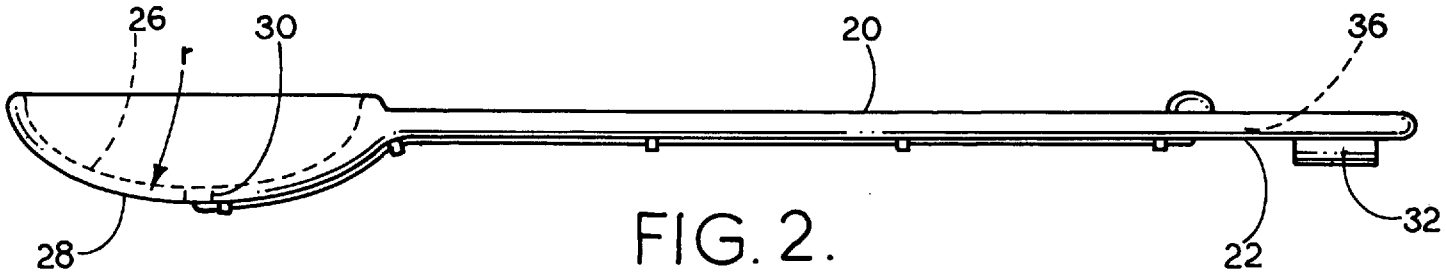
FIG. 2 is a side elevational view thereof showing the longitudinal cross section thereof.
Figure 3:
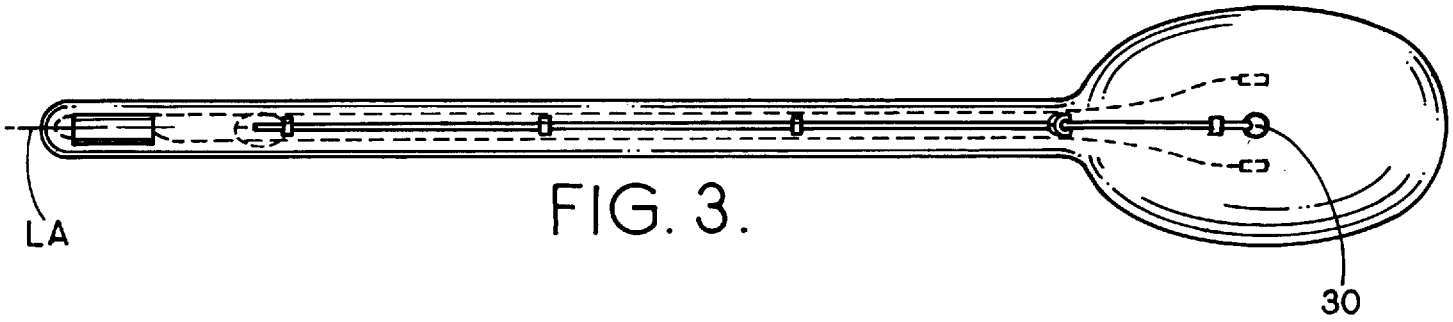
FIG. 3 is a bottom plan view thereof.
Figure 4:
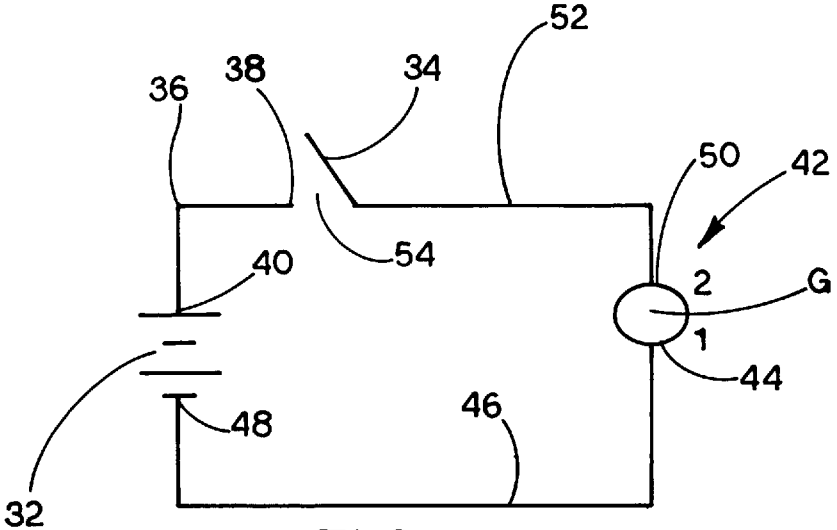
FIG. 4 is a circuit diagram of the igniter.

More specifically, igniter 10 comprises a base element 12 which includes a handle 14 having a proximal end 16 and a distal end 18. As shown in FIG. 2, handle 14 also includes a top surface 20 and a bottom surface 22. A bowl element 24 is located on distal end 18 of handle 14. End 18 can be curved to have a convex top surface so the bowl is properly oriented for certain burners.

As best shown in FIG. 2, bowl element 24 has a crescent-shaped longitudinal cross-section, a concave upper surface 26, and a convex lower surface 28 for capturing gas flowing from a flame fuel port. The shape of this bowl also retains the gas long enough for the igniter to efficiently ignite the fuel without extinguishing the igniter or being insufficient to ignite.

A bore 30 extends from upper surface 26 of bowl element 24 to lower surface 28 of the bowl element to fluidically connect upper surface 26 of the bowl element to lower surface 28 of the bowl element for controlling the amount of fuel trapped and retained in the bowl in position to be ignited. The size of the bore is set to co-operate with the fuel flow rates associated with most fuel burner flame ports so some fuel flows through the bore and some is retained in the bowl. As will be understood by those skilled in the art based on the teaching of the present disclosure, the bore acts as an orifice to regulate the flow rate of fuel flowing through bowl element 24 based on the upstream pressure of the fuel flowing into the bowl and the size of the bore. This flow is further adjusted by the shape of the bowl as will be understood from the following discussion.

Figure 1:
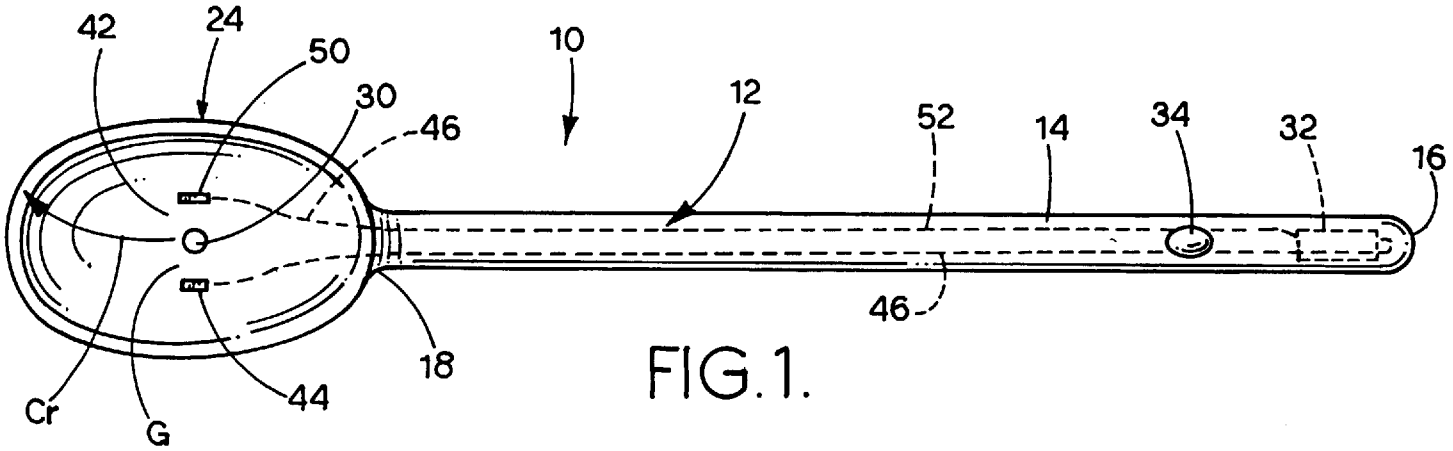
FIG. 1 is a top plan view of the flameless igniter for use with a tank burner of a fluid fuel system embodying the present invention.

Upper surface 26 of bowl element 24 is in the shape of a ellipsoid of revolution and holds fuel flowing thereinto and influences the flow rate of the fuel flowing through element 24. The radius of curvature r of the ellipsoid and the curvature radius cr indicated in FIG. 1 is adjusted so the amount of fuel trapped in the element 24 is proper to make efficient use of the fuel during ignition and re-ignition of a flame.

As indicated in the figures, igniter 10 further includes an igniter system which comprises a power source 32, such as a battery, mounted on bottom surface 22 of handle 14 near proximal end 16 of handle 14. The power source also acts as a balance for igniter 10 as well as a hand-grasping element.

The igniter system further includes a switch element 34, such as a pushbutton switch, mounted on top surface 20 of handle 14 near proximal end 16 of the handle. A bore is defined through the handle adjacent to switch 32, and a first electrical conductor 36 mounted on bottom surface 22 of handle 14 extends through the bore and electrically connects one side 38 of switch element 34 in series to one side 40 of power source 32.

A spark gap element 42 is mounted on upper surface 26 of bowl element 24 adjacent to bore 30 and has a first electrode 44 mounted on the upper surface of bowl element adjacent to bore 30. A second electrical conductor 46 is mounted on the bottom surface of bowl element 24 and extends through bowl element 24 and connects first electrode 44 in series to a second side 48 of power source 32. A second electrode 50 is mounted on upper surface 26 of bowl element 24 adjacent to bore 30 and is spaced from first electrode 44 to define a spark gap G. Second electrode 50 is positioned on a diametrically opposite side of bore 30 to first electrode 44 so that bore 30 is interpositioned in spark gap G between first and second electrodes 44 and 50. The spark gap element further includes a third electrical conductor 52 mounted on bottom surface 28 of bowl element 24 and extends through bowl element 24. Electrical conductor 52 connects second electrode 50 in series to a second side 54 of switch element 34.

Power source 32 and spark gap G are sized so a spark jumps from one electrode to the other electrode when switch element 34 is closed. The spark contains enough energy to ignite the fuel retained in element 24 adjacent to spark gap G. The amount of fuel is sufficient to efficiently ignite the flame, and bore 30 is sized to permit enough fuel to flow past spark gap G so ignition occurs and the spark is not blown out.

As can also be seen in the figures, handle 14 has a longitudinal axis LA extending from proximal end 18 to distal end 16. First and second electrodes 44 and 50 are elongated and are oriented on element 24 to extend parallel to each other and parallel to longitudinal axis LA. This orientation enhances the efficient use of fuel during the ignition process.

It is understood that while certain forms of the present invention have been illustrated and described herein, it is not to be limited to the specific forms or arrangements of parts described and shown.

I claim:

1. A flameless igniter for use with a tank burner of a fluid fuel system comprising:

A) a base element which includes (1) a handle having a proximal end, a distal end, a top surface and a bottom surface, (2) a bowl element on the distal end of said handle, said bowl element having (a) a crescent-shaped longitudinal cross-section, (b) a concave upper surface, (c) a convex lower surface, (d) a bore extending from the upper surface of the bowl element to the lower surface of the bowl element to fluidically connect the upper surface of the bowl element to the lower surface of the bowl element, (e) the upper surface of said bowl element being in the shape of a ellipsoid of revolution; and B) an igniter system which comprises (1) a power source mounted on the bottom surface of said handle near the proximal end of said handle, (2) a switch element mounted on the top surface of said handle near the proximal end of said handle, (3) a first electrical conductor mounted on the bottom surface of said handle and electrically connecting one side of said switch element in series to one side of said power source, (4) a spark gap element mounted on the upper surface of said bowl element adjacent to said bore and having (a) a first electrode mounted on the upper surface of said bowl element adjacent to said bore, (b) a second electrical conductor mounted on the bottom surface of said bowl element and extending through said bowl element and connecting said first electrode in series to a second side of said power source, (c) a second electrode mounted on the upper surface of said bowl element adjacent to said bore and spaced from said first electrode, said second electrode being positioned on a diametrically opposite side of said bore to said first electrode so that said bore is interpositioned between said first and second electrodes, and (d) a third electrical conductor mounted on the bottom surface of said bowl element and extending through said bowl element and connecting said second electrode in series to a second side of said switch element;

C) said power source and said spark gap being sized so a spark jumps from one electrode to the other electrode when said switch element is closed.

2. The igniter defined in claim 1 wherein said handle has a longitudinal axis extending from said proximal end to said distal end and said first and second electrodes are elongated and are oriented to extend parallel to each other and to said longitudinal axis.

* * * * *